US006793082B1

(12) United States Patent
Long, Jr.

(10) Patent No.: US 6,793,082 B1
(45) Date of Patent: Sep. 21, 2004

(54) SNAP-ON SCREW-OFF CLOSURE FOR USE IN COMBINATION WITH A CONTAINER

(75) Inventor: Charles J. Long, Jr., New Castle, PA (US)

(73) Assignee: International Plastics and Equipment Corporation, New Castle, PA (US)

( * ) Notice: Subject to any disclaimer, the term of this patent is extended or adjusted under 35 U.S.C. 154(b) by 0 days.

(21) Appl. No.: 09/145,690

(22) Filed: Sep. 2, 1998

Related U.S. Application Data

(63) Continuation-in-part of application No. 08/961,440, filed on Oct. 30, 1997, now Pat. No. 6,059,134.

(51) Int. Cl.[7] ..... B65D 41/34

(52) U.S. Cl. ..... 215/252; 215/318; 215/354; 215/253

(58) Field of Search ..... 215/354, 318, 215/252, 253, 320, 355, 321, 341, 343, 344, 44, 45; 220/296, 796, 801, 802

(56) References Cited

U.S. PATENT DOCUMENTS

| | | | | | |
|---|---|---|---|---|---|
| 3,750,821 | A | * | 8/1973 | Sourbet et al. | 215/252 |
| 3,817,418 | A | * | 6/1974 | Mastrovito | |
| 3,825,144 | A | * | 7/1974 | Wiedmer | |
| 3,865,263 | A | * | 2/1975 | Birch | |
| 4,098,422 | A | * | 7/1978 | Slomski | |
| 4,126,240 | A | * | 11/1978 | Brach | 215/252 |
| 4,196,818 | A | * | 4/1980 | Brownbill | 215/252 |
| 4,206,852 | A | * | 6/1980 | Dunn et al. | 215/252 |
| 4,278,180 | A | * | 7/1981 | Willis | 215/252 |
| 4,343,408 | A | * | 8/1982 | Csaszar | 215/252 |
| 4,416,383 | A | * | 11/1983 | Frahm et al. | |
| 4,448,319 | A | * | 5/1984 | Kern | |
| 4,546,893 | A | * | 10/1985 | Stull | 215/252 |
| 4,550,843 | A | * | 11/1985 | Nolan | 215/252 |
| 4,884,706 | A | * | 12/1989 | Julian | 215/252 |
| 4,899,898 | A | * | 2/1990 | Thompson | 215/252 |
| 4,913,300 | A | * | 4/1990 | Weidmer et al. | 215/252 |
| 5,056,675 | A | * | 10/1991 | Julian | 215/252 |
| 5,215,204 | A | * | 6/1993 | Beck et al. | 215/252 |
| 5,246,125 | A | * | 9/1993 | Julian | 215/252 |
| 5,271,512 | A | * | 12/1993 | Ekkert | 215/252 |
| 5,307,946 | A | * | 5/1994 | Molinaro | |
| 5,379,910 | A | * | 1/1995 | Montgomery | |
| 5,397,009 | A | * | 3/1995 | Salmon et al. | 215/252 |
| 5,450,972 | A | * | 9/1995 | Zemlo | 215/252 |
| 5,456,375 | A | * | 10/1995 | May | 215/252 |
| 5,480,045 | A | * | 1/1996 | Molinaro et al. | |
| 5,484,071 | A | * | 1/1996 | Zumbuhl | 215/256 X |
| 5,487,481 | A | * | 1/1996 | Sander et al. | 215/252 |
| 5,588,562 | A | * | 12/1996 | Sander et al. | 215/252 X |
| 5,593,055 | A | * | 1/1997 | Repp et al. | |
| 5,657,906 | A | | 8/1997 | Rapchak et al. | |
| 5,662,247 | A | | 9/1997 | Rapchak et al. | |
| 5,676,269 | A | * | 10/1997 | Blake et al. | 215/252 |
| 5,680,945 | A | * | 10/1997 | Sander et al. | 215/252 |
| 5,685,443 | A | * | 11/1997 | Taber et al. | 215/252 |
| 5,699,924 | A | * | 12/1997 | Mascio et al. | 215/252 |
| 5,738,231 | A | * | 4/1998 | Montgomery | |
| 5,779,075 | A | * | 7/1998 | Salmon et al. | 215/252 |
| 5,853,095 | A | * | 12/1998 | Marshall et al. | 215/252 |
| 6,059,134 | A | * | 5/2000 | Long | 215/252 |

FOREIGN PATENT DOCUMENTS

| | | | | |
|---|---|---|---|---|
| AT | 245415 | * | 6/1965 | |
| CA | 812597 | * | 5/1969 | 215/318 |
| DE | 48201 | * | 5/1969 | 215/252 |
| DE | 3025738 | * | 1/1982 | 215/252 |
| EP | 80846 | * | 6/1983 | 215/252 |
| EP | 103567 | * | 3/1984 | 215/252 |
| FR | 1536459 | * | 7/1968 | |
| FR | 2421812 | * | 12/1979 | |
| FR | 2659065 | * | 9/1991 | 215/252 |
| FR | 2692555 | * | 12/1993 | 215/252 |
| WO | WP 94/18084 | * | 8/1994 | 215/252 |
| WO | WO 96/23699 | * | 8/1996 | |
| WO | WO 97/38912 | * | 10/1997 | |

* cited by examiner

*Primary Examiner*—Robin A. Hylton
(74) *Attorney, Agent, or Firm*—Cohen & Grigsby, P.C.

(57) ABSTRACT

The present invention provides a closure with a thread configuration adapted for snap-on or screw-on application to a container neck finish. The closure is optionally provided with at least one member attached to the tamper-indicating ring which cooperates with the arcuate projection to assist in breaking said indicating ring during removal of the closure from the container neck.

14 Claims, 4 Drawing Sheets

SNAP-ON SCREW-OFF CLOSURE FOR USE IN COMBINATION WITH A CONTAINER

CROSS-REFERENCE

This application is a continuation-in-part (CIP) of U.S. patent application Serial No. 08/961,440 filed Oct. 30, 1997 now U.S. Pat. No. 6,059,134, the disclosure of which is incorporated herein by reference.

RELATED APPLICATIONS

One family of related patent applications assigned to the assignee of the present application include U.S. patent application Ser. No. 09/067,583 filed Apr. 28, 1998, which is a continuation-in-part of U.S. patent application Ser. No. 08/948,342 filed Oct. 8, 1997, which is a continuation-in-part of U.S. patent application Ser. No. 08/927,311 filed Sep. 11, 1997, which is a continuation-in-part of U.S. patent application Ser. No. 08/749,488 filed on Nov. 15, 1996, which is a continuation-in-part of U.S. patent application Ser. No. 08/603,148 filed on Feb. 15, 1996. Another family of related patent applications assigned to the assignee of the present application include U.S. patent application Ser. No. 08/927,743 filed Sep. 11, 1997, which is a continuation-in-part of U.S. patent application Ser. No. 08/838,133 filed on Apr. 15, 1997, which is a continuation-in-part of U.S. patent application Ser. No. 08/687,149 filed on Jul. 24, 1996, which is a continuation-in-part of U.S. patent application Ser. No. 08/633,225 filed on Apr. 16, 1996.

FIELD OF THE INVENTION

The present invention relates to a closure and neck finish for blow-molded containers and in particular to a snap-on closure with a tamper evident locking feature that can be screwed off the container after initial application and then reapplied by screwing the closure onto the container.

BACKGROUND OF THE INVENTION

Tamper evident caps for containers, such as blow-molded or injection molded containers are well known, see e.g., U.S. Pat. Nos. 4,561,553, 4,625,875, 4,497,765, and 4,534,480. A number of caps are of the snap-on screw-off variety such as U.S. Pat. Nos. 5,553,727, 5,190,178, 5,213,224, 5,267,661, 5,285,912, 5,480,045, 5,456,376, and 5,307,946 and 5,560, 504. Generally, the prior art caps include a spiral thread or threads which match a spiral thread on the neck of the bottle. In U.S. Pat. No. 5,307,946 the cap and bottle neck include a seven lead-in end annular spiral thread configuration (or fastening means) and in U.S. Pat. No. 5,553,727 the cap and bottle neck include a ten lead-in end annular spiral thread configuration (or fastening means). The advantage of the multiple lead-in threads is the increased ease of "snap-on" placement of the cap onto the threaded neck using standard bottle capping equipment and without an additional tightening step such as a final twist.

As is apparent from the prior art patents, a great deal of effort has gone into design of cap and bottle neck configurations to provide easy on and off use of the cap by the bottler and ultimately by the end user of the bottled product. However, notwithstanding this effort, the bottling industry continues to search for a cap and neck finish which achieves these objectives but which also provides a secure seal.

The present invention solves this problem by optionally providing at least one annular sealing bead depending from the outer surface of the closure valve which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also solves the problem of protecting the integrity of frangible elements during installation of threaded tamper-evident closures. A plurality of elevated areas extend upwardly from the tamper-evident band in spaced relation to the bottom edge of the closure body. The purpose of these elevated areas is to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band. The purpose of attaching frangible elements to the elevated areas of the tamper-evident band is to assist in preventing axial misalignment of the tamper-evident band relative to the annular depending skirt portion of the closure upon subjecting the closure to torquing forces during assembly to the container neck.

At least one and preferably a plurality of circumferentially spaced lugs optionally extend from the exterior wall of the container neck. These lugs facilitate breaking the frangible elements on the tamper-evident band of the closure by engaging the frangible elements as the closure is twisted off the container neck following initial snap-on application.

Additionally, the tamper indicating closure may include at least one arcuate projection extending around at least a portion of the tamper indicating ring arranged for registration with an annular locking flange on a container neck portion on which the closure is positioned. The closure is provided with at least one member attached to the tamper-indicating ring which cooperates with the arcuate projection to assist in breaking the tamper indicating ring during removal of the closure from the container neck. The arcuate projection is held in place by the locking flange on the container neck as the member is pulled away from the arcuate projection during twist-off removal of the closure body to cause the tamper indicating ring to break at a weakened area.

Accordingly, it is an object of the present invention to improve sealing engagement between the closure and the mating portions of the interior wall of the container neck by including at least one annular sealing bead depending from the outer surface of the closure valve which are compressed against the inner surface of the container neck to form a seal as the closure is snapped onto the container neck.

It is a further object of the present invention to improve sealing engagement between the closure and the mating portions of the exterior wall of the container neck by including one or more annular sealing beads on the interior surface of the closure depending annular skirt.

It is a further object of the present invention to provide a lug configuration for facilitating the breakage of frangible elements on the tamper evident band of the closure.

It is a further object of the present invention to provide a threaded tamper-evident closure having frangible elements attached from and between a plurality of elevated areas extending upwardly from the tamper-evident band, for protecting the integrity of frangible elements during installation of the closure on a bottle neck.

It is a further object of the present invention to provide a closure with at least one member attached to the tamper-indicating ring which cooperates with the arcuate projection to assist in breaking the tamper indicating ring during removal of the closure from the container neck.

SUMMARY OF THE INVENTION

The present invention provides a closure with a thread configuration adapted for snap-on or screw-on application to a container neck finish. Preferably the closure and neck finish contain eight or nine mating continuous or discontinuous threads for this purpose.

The present invention preferably provides at least one annular sealing bead depending from the outer surface of the closure inner annular sealing flange which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band to assist in preventing axial misalignment of the tamper-evident band relative to the annular depending skirt portion of the closure upon subjecting the closure to torquing forces during assembly to the container neck.

Additionally, the tamper indicating closure may include at least one arcuate projection extending around at least a portion of the tamper indicating ring arranged for registration with an annular locking flange on a container neck portion on which the closure is positioned. The closure is optionally provided with at least one member attached to the tamper-indicating ring which cooperates with the arcuate projection to assist in breaking the tamper indicating ring during removal of the closure from the container neck. The arcuate projection is held in place by the container neck as the member is pulled away from the arcuate projection during twist-off removal of the closure body to cause the tamper indicating ring to break at a weakened area.

At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application.

Other advantages of the present invention will become apparent by a perusal of the following detailed description of a presently preferred embodiment of the invention taken in connection with the drawings.

DETAILED DESCRIPTION OF THE PRESENTLY PREFERRED EMBODIMENT

Figure 1:
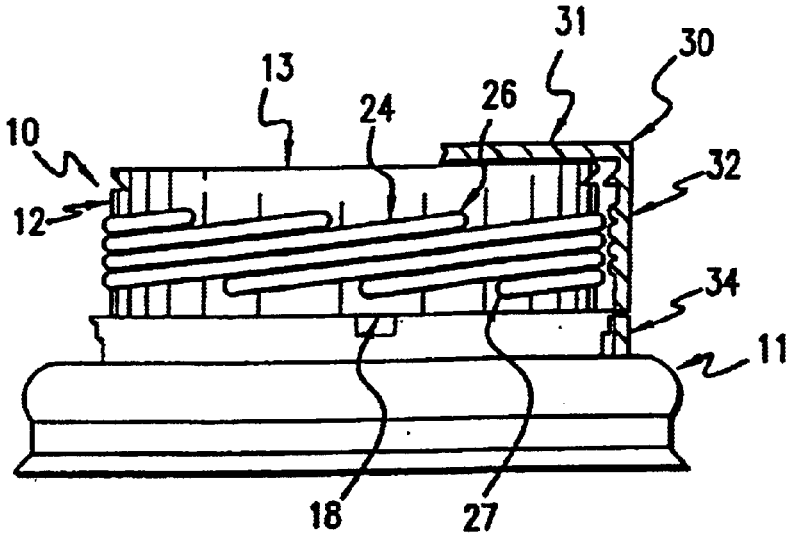
FIG. 1 is an elevation in partial section of a bottle neck finish and closure according to the present invention.
Figure 1A:
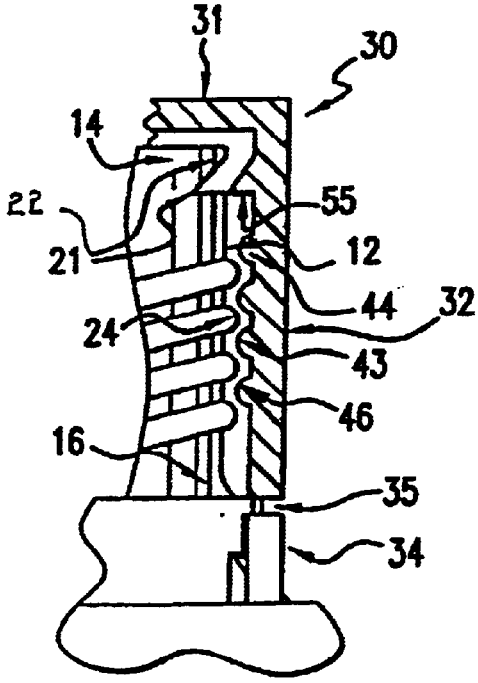
FIG.1A is an enlarged view of the circumferential mating engagement of the closure and container neck shown in FIG. 1.

Referring to FIGS. 1 and 1A, the neck finish 10 of a container 11 is partially shown. Neck finish 10 is preferably made of plastic and more preferably a high density plastic suitable for blow molding manufacture of the neck finish 10. Neck finish 10 includes an annular wall 12 having a first end 14 and a second end 16 and defining a cylindrical opening 13 within the neck finish 10, with first end 14 providing access to opening 13.

Positioned adjacent to second end 16 is at least one and preferably a plurality of circumferentially spaced lugs 18 projecting from the exterior wall of the container neck. Lugs 18 may be preferably positioned around the entire circumference of the annular wall 12 or alternately only a portion thereof. Lugs 18 facilitate breaking the frangible elements on the tamper-evident band 34 of the closure 30 by engaging frangible elements 35 connecting the tamper-evident band 34 to the closure 30 as the closure 30 is twisted off the container neck 10 following initial snap-on application of the closure 30.

Helically extending between first end 14 and the second end 16 of the annular wall 12 are an appropriate number of threads to permit snap-on or screw-on application, preferably eight or nine threads 24 terminating at points 26 and 27 proximate to the first end 14 and second end 16 of annular wall 12, respectively. Preferably, threads 24 are helically spaced in a continuous relationship as shown in FIG.1 but threads 24 can alternately be discontinuous and can take on any cross-sectional profile suitable for mating with threads 43 on the closure 30 during snap and screw-on application of the closure 30 to the neck finish 10.

Closure 30 is preferably made from a low or high density polypropylene suitable for blow molding manufacturing. Cap 30 comprises a closure member 31 designed to cover the cylindrical opening 13 of the container neck finish 10. In a preferred embodiment of the invention, closure member 31 is substantially circular and an annular wall 32 circumferentially surrounding at least a portion of neck finish 10 depends from closure member 31.

Figure 2:
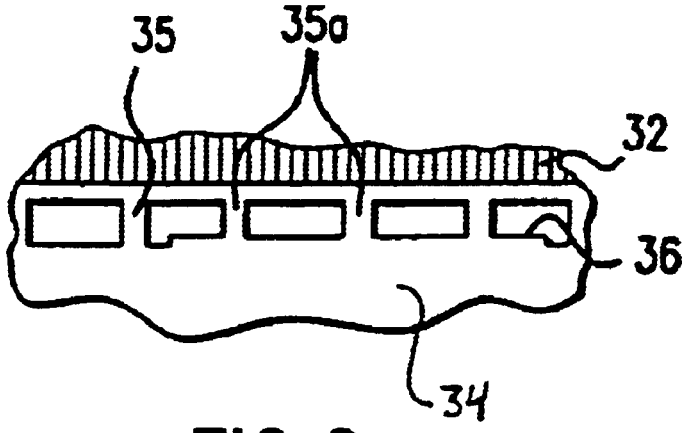
FIGS. 2 and 2A are enlarged sectional views of the tamper-evident band of the closure of the present invention.
Figure 2A:
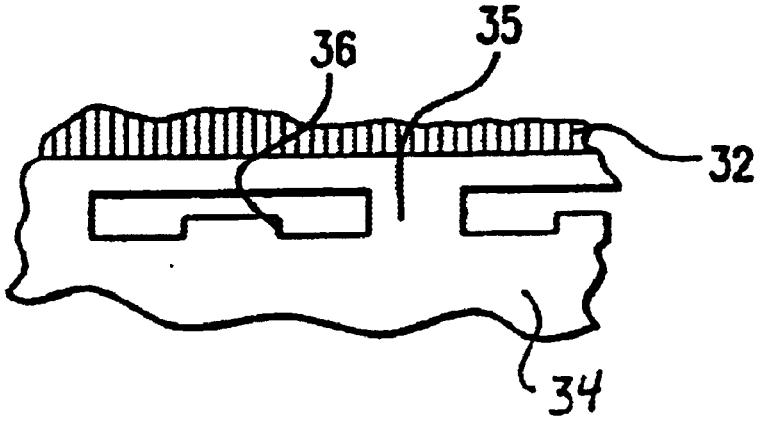

Annular wall 32 includes a tamper-evident band 34 around the end opposite the closure member 31. Tamper-evident band 34 includes at least one and preferably a plurality of frangible elements 35 extending around at least a portion of the circumference of the tamper-evident band 34. As shown in FIGS. 2 and 2A, at least one and preferably a plurality of elevated areas 36 extend upwardly from the tamper-evident band 34 in spaced relation to the bottom edge of annular wall 32. The purpose of these elevated areas is to support the tamper evident band 34 in resisting vertical movement imparted by insertion of the closure on the bottle neck, thereby protecting the frangible elements 35 during assembly. As shown in FIG.2, the frangible elements 35*a* connecting the tamper-evident band 34 to the lower edge of annular wall 32 may be configured to extend from these elevated areas 36 as well as from the non-elevated areas of the tamper-evident band 34. The purpose of attaching frangible elements to the elevated areas 36 of the tamper-evident band 34 is to assist in preventing axial misalignment of the tamper-evident band 34 relative to the annular wall portion 32 of the closure 30 upon subjecting the closure, 30 to torquing forces during snap-on assembly to the container neck finish 10.

Figure 4:
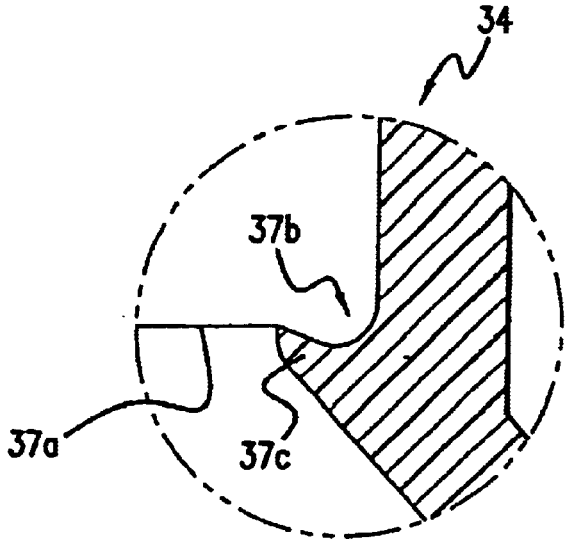
FIG. 4 is an exploded view of the arcuate locking projection of the present invention.

Optionally, tamper-evident band 34 may be configured with at least one or more arcuate flanged locking projections 37 circumferentially spaced about the inner surface of the tamper evident ring 34 and positioned so that they are engageable under an annular locking flange on a bottle neck (not shown) to lock the closure 30 on the bottle neck. As can be seen in FIG. 4, arcuate projections 37 can comprise edges 37*a* defining grooves 37*b* formed on radially upwardly extending annular flanges 37*c*. Flanges 37*c* can be discontinuous or continuous. Edge 37*a* and groove 37*b* provide a "hook" shape for engaging the annular locking flange on the container neck (not shown) which has a radius substantially the same as groove 37*b*. The surface of flange 37*c* may lie at an angle with a plane normal to the inner surface of the tamper-evident band 34, thereby defining a grooved "hook" with a reverse basis allowing flange 37*c* to slide over the locking flange on the bottle neck when the closure is placed on the container but which engages and locks the closure to the container when removal of the closure is attempted with the tamper-evident band 34 intact. The aforementioned angle may vary over the surface of flange 37*c* such that at least a portion of the flange surface lies substantially parallel to the interior surface of the tamper indicating band 34. This flanged edge and groove configuration 37*a*–37*c* may be positioned at any elevation the surface of tamper-evident band 34, including a position adjacent to the bottom edge of tamper-evident band 34 as shown in FIG. 4. Because groove 37*b* is undercut, a mold core must be used that frees or permits removal of undercut prior to stripping the closures from the mold. Various techniques are known to those skilled in the art including the use of movable core sleeves which free the undercut section of the mold.

Figure 5:
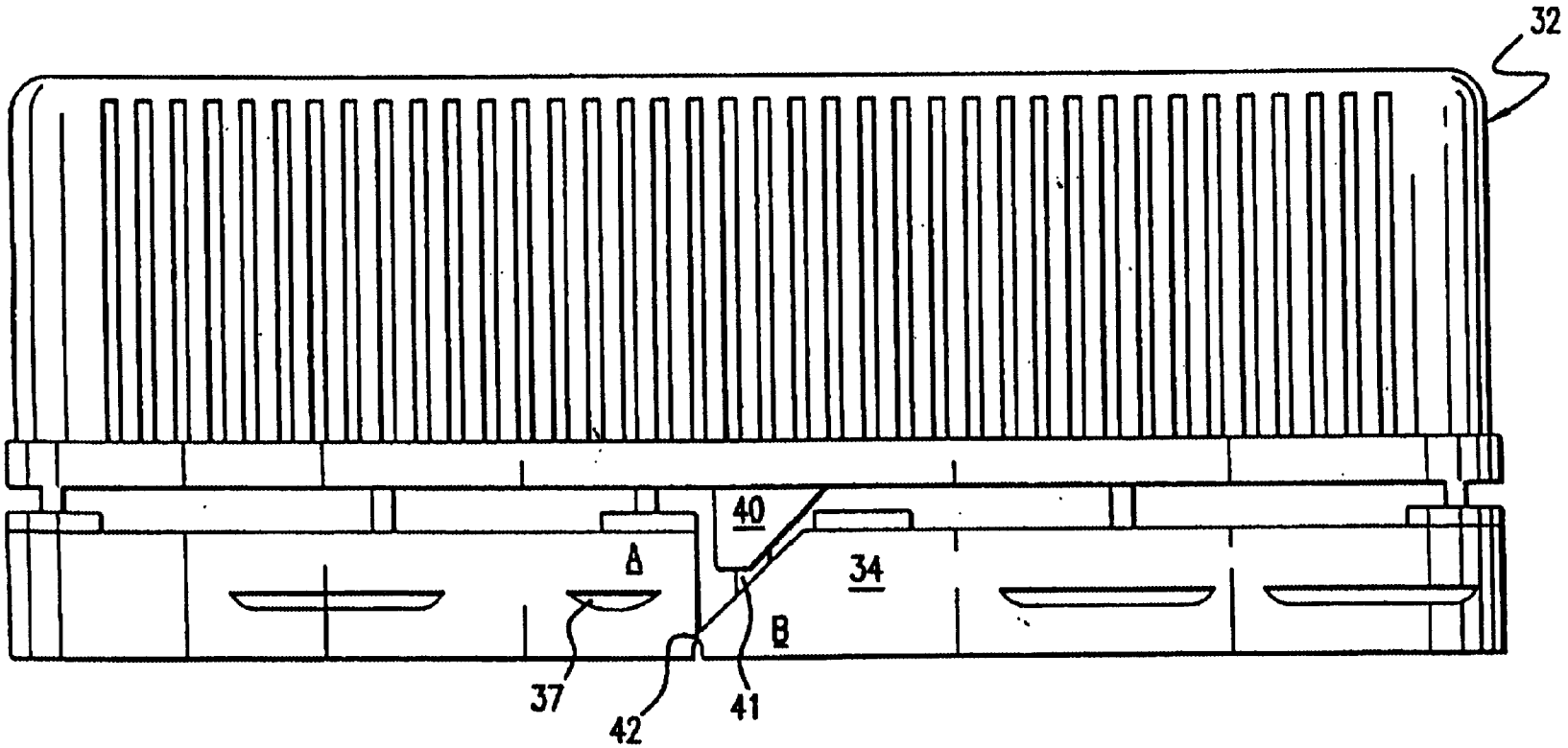
FIG. 5 is a plan view of the closure showing the cooperation of the arcuate locking projection with a member extending from the closure body to facilitate breaking the tamper-evident band.

As shown in FIG. 5, tamper-evident band 34 is also attached to a member 40 extending from annular wall 32 to facilitate breaking the tamper-evident band 34 when unscrewing the closure 30 to remove it from the neck finish 10 of the container 11. Preferably member 40 is also attached to the tamper-evident band 34 by a strip 41 of material extending between member 40 and tamper-evident band 34 and located proximate to a weakened area 42 formed in the tamper evident band 34. The unscrewing of the closure 30 from the container neck finish 10 produces an upward force on the member 40 which is translated through strip 41 to the attached portion B of the tamper-evident band 34. This upward force acts in concert with a downward force exerted by interference between the container neck finish 10 and the portion A of the tamper-evident band 34 containing arcuate flange 37 to cause the weakened area 42 to rupture, thereby breaking the tamper-evident band 34 to allow the closure 30 to be removed from the container 11. The tamper-evident band 34 will remain with the closure 30 due to the strip 41 attaching the member 40 to the tamper-evident band 34. Strip 41 can subsequently be completely broken away to allow removal of the tamper-evident band 34 from the closure 30.

Extending from a location proximate to closure member 31 to a location proximate to tamper-evident band 35 are an appropriate number of threads to permit snap-on or screw-on application, preferably eight or nine helically spaced threads 43 on the inner surface of annular depending wall 32 each having respective lead openings 44 and 46. Preferably, closure threads 43 are helically spaced in a continuous relationship as shown in FIG. 1A but threads 43 can alternately be discontinuous and can take on any cross-sectional profile suitable for mating with threads 24 on the container neck finish 10 during snap and screw-on application of the closure 30 to the neck finish 10.

Figure 3:
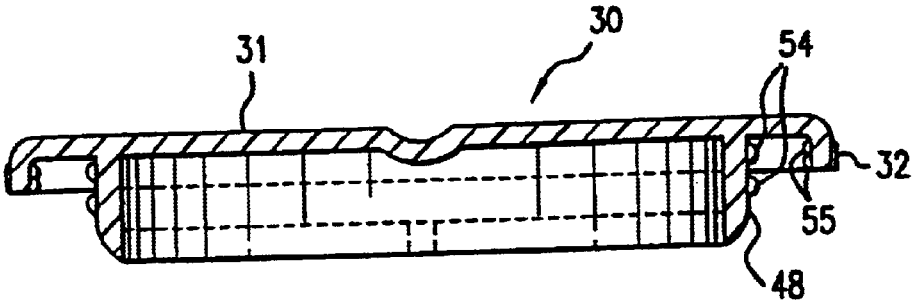
FIG. 3 is a sectional view of the closure sealing valve as it is attached to the closure of the present invention.

As shown in FIG. 3, depending from closure member 31 is depending annular inner annular sealing flange 48. Annular inner annular sealing flange 48 is spaced apart from annular depending closure wall 32 a distance which is represented by the difference in the radial distance between the outer surface of the annular neck finish wall 12 and the center of the circumferential opening 13 on the one hand and the radial distance between the inner surface of annular wall 12 and the center of the circumferential opening 13 on the other hand. Preferably inner annular sealing flange 48 includes a taper proximate to its lower edge which permits initial engagement of the inner annular sealing flange 48 to the inner periphery of the neck finish 10 opening upon application of the closure 30 to the neck finish 10. Optionally, inner annular sealing flange 48 contains at least one and preferably a plurality of annular sealing beads 54 depending from the outer surface of the closure inner annular sealing flange which are compressed against the inner surface of the container neck annular wall 12 to form a seal as the closure 30 is snapped onto the container neck 10. Annular sealing beads 54 also contribute to the sealing force of the closure disk 31 against the container neck finish 10 as beads 54 lock beneath corresponding flanges on the inner surface of the container neck 10 (not shown).

Optionally, sealing engagement between the closure 30 and the mating portions of the exterior of the container neck annular wall 12 may be further improved by including one or more annular sealing beads 55 extending around at least a portion of the interior surface of the closure depending annular skirt 32. In the preferred embodiment an annular sealing bead 55 is positioned on annular wall 32 proximate of closure element 31 and is located and dimensioned to engage and cooperatively secure closure 30 to an annular ring flange 22 or groove 21 on neck finish 10 when the cap is snapped onto the neck finish 10.

Cap 30 when used in combination with neck finish 10 of the present invention permits the placement of the cap on the neck finish by snap-on or twist-on application. By preferably utilizing eight or nine threads 24 and 43, it is not necessary to screw the cap on or off the neck. However, by twisting the cap it is possible to obtain an even more secure closure when used by the ultimate consumer, while at the same time providing a leak proof container at the capping station without the necessity of so twisting.

While presently preferred embodiments of the invention have been shown and described in particularity, the invention may be otherwise embodied within the scope of the appended claims.

What is claimed is:

1. A tamper indicating closure configured for snap-on or screw-on application to a container, said closure comprising:

a. a closure top portion;

b. an annular depending skirt extending from said top portion, said depending skirt having an internal thread configuration adapted for engaging an external thread configuration on the neck portion of said container by snap-on application during initial installation of said closure to the container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicating ring arranged for registration with a container neck portion on which said closure is positioned and said closure includes at least one non-removable member breakably attached to said tamper-indicating ring which cooperates with at least one said arcuate projection to assist in breaking said tamper indicating ring during removal of said closure from said container neck;

wherein at least one said arcuate projection is held in place by an annular locking flange on the container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection;

wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area;

wherein said elevated areas extending from said tamper indicating ring are of a known vertical height, and said frangible elements are of a height greater than that of said known height of said elevated areas; and wherein said at least one of said frangible elements is broken by a projection located on said container neck and configured for engaging said at least one said frangible elements to disconnect said closure from said tamper indicating ring upon twist-off removal of said closure from said container neck.

2. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicating ring arranged for registration with a container neck portion on which said closure is positioned and said closure includes at least one non-removable member breakably attached to said tamper-indicating ring which cooperates with at least one said arcuate projection to assist in breaking said tamper indicating ring during removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection;

wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area;

wherein said elevated areas extending from said tamper indicating ring are of a known vertical height, and said frangible elements are of a height greater than that of said known height of said elevated areas; and wherein said at least one said frangible elements is broken by a projection located on said container neck and configured for engaging said at least one said frangible elements to disconnect said closure from said tamper indicating ring upon twist-off removal of said closure from said container neck.

3. The tamper indicating closure of claim 1 or 2, wherein said inner annular sealing flange includes at least one annular sealing bead extending around said inner annular sealing flange and being configured for engagement with the interior surface of said container neck finish.

4. The tamper indicating closure of claim 1 or 2, wherein said inner annular sealing flange includes at least one annular sealing bead extending around said inner annular sealing flange and being configured for engagement with the interior surface of said container neck finish.

5. The tamper indicating closure of claim 4, wherein said annular depending skirt includes at least one annular sealing bead extending around said skirt and being configured for engagement with the exterior surface of said container neck finish.

6. The tamper indicating closure of claim 5, wherein at least one said annular sealing bead engages a sealing groove on the exterior of said container neck finish.

7. The tamper indicating closure of claim 5, wherein said thread configurations contain eight or nine circumferentially spaced individual thread leads.

8. The tamper indicating closure of claim 7, wherein said thread leads are segmented.

9. The tamper indicating closure of claim 1 or 2, wherein said annular depending skirt includes at least one annular sealing bead extending around said skirt and being configured for engagement with the exterior surface of said container neck finish.

10. The tamper indicating closure of claim 9, wherein at least one said annular sealing bead engages a sealing groove on the exterior of said container neck finish.

11. The tamper indicating closure of claim 1 or 2, wherein said thread configurations contain eight or nine circumferentially spaced individual thread leads.

12. The tamper indicating closure of claim 4, wherein said thread leads are segmented.

13. The tamper indicating closure of claim 1 or 2, wherein at least one said arcuate projection comprises a grooved locking member.

14. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicating ring arranged for registration with a container neck portion on which said closure is positioned and said closure includes at least one non-removable member breakably attached to said tamper-indicating ring which cooperates with at least one said arcuate projection to assist in breaking said tamper indicating ring during removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection;

wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area; and wherein said at least one of said frangible elements is broken by a projection located on said container neck and configured for engaging said at least one of said frangible elements disconnect said closure from said tamper indicating ring upon twist-off removal of said closure from said container neck.

* * * * *